US007185467B2

(12) United States Patent
Marty

(10) Patent No.: US 7,185,467 B2
(45) Date of Patent: Mar. 6, 2007

(54) MODULAR SYSTEM OF PERMANENT FORMS FOR CASTING REINFORCED CONCRETE BUILDINGS ON SITE

(76) Inventor: Oscar Marty, Caoba 35, San Juan, PR (US) 00913

( * ) Notice: Subject to any disclaimer, the term of this patent is extended or adjusted under 35 U.S.C. 154(b) by 450 days.

(21) Appl. No.: 10/679,849

(22) Filed: Oct. 6, 2003

(65) Prior Publication Data

US 2005/0072061 A1 Apr. 7, 2005

(51) Int. Cl.
*E04B 2/00* (2006.01)

(52) U.S. Cl. ..... 52/425; 52/79.14; 52/293.1; 52/294; 52/582.1; 52/429; 52/270; 52/259; 52/745.1; 52/745.13

(58) Field of Classification Search ..... 52/79.1, 52/79.5, 292, 294, 293.1, 293.2–293.3, 582.1, 52/295, 415–417, 404.1, 409, 259, 411–412, 52/425–426, 745.1, 745.13, 429–430, 435–442; 264/35

See application file for complete search history.

(56) References Cited

U.S. PATENT DOCUMENTS

| | | | | | |
|---|---|---|---|---|---|
| 1,254,109 | A | * | 1/1918 | Atterbury | 52/236.7 |
| 1,353,702 | A | * | 9/1920 | Aschauer | 52/281 |
| 1,469,955 | A | | 10/1923 | Reilly | |
| 1,757,077 | A | | 5/1930 | Eiserloh | |
| 2,043,697 | A | * | 6/1936 | Deichmann | 52/372 |
| 2,335,948 | A | * | 12/1943 | Leemhuis | 52/281 |
| 2,741,908 | A | * | 4/1956 | Swanson | 52/274 |
| 2,851,873 | A | | 9/1958 | Wheeler-Nicholson | |
| 3,300,943 | A | | 1/1967 | Owens | |
| 3,600,862 | A | | 8/1971 | Eckert | |
| 3,662,506 | A | | 5/1972 | Dillon | |
| 3,712,008 | A | * | 1/1973 | Georgiev et al. | 52/79.12 |
| 3,772,835 | A | | 11/1973 | Cox et al. | |
| 3,780,480 | A | | 12/1973 | Cvijanovic et al. | |
| 3,818,660 | A | | 6/1974 | Dillon | |
| 3,834,095 | A | | 9/1974 | Ohlson | |
| 3,846,946 | A | | 11/1974 | Sandstrom et al. | |
| 3,952,471 | A | | 4/1976 | Mooney | |
| 3,959,423 | A | * | 5/1976 | Boyd | 264/34 |
| 3,984,957 | A | * | 10/1976 | Piazza | 52/309.9 |
| RE29,249 | E | | 6/1977 | Rice | |
| 4,050,213 | A | | 9/1977 | Dillon | |
| 4,081,935 | A | * | 4/1978 | Wise | 52/236.8 |
| 4,098,040 | A | * | 7/1978 | Riefler | 52/223.7 |
| 4,127,971 | A | * | 12/1978 | Rojo, Jr. | 52/79.11 |
| 4,147,009 | A | | 4/1979 | Watry | |
| 4,158,942 | A | | 6/1979 | Hart | |
| 4,178,343 | A | | 12/1979 | Rojo, Jr. | |
| 4,269,006 | A | * | 5/1981 | Larrow | 52/79.1 |
| 4,336,675 | A | | 6/1982 | Pereira | |
| 4,343,125 | A | | 8/1982 | Shubow | |

(Continued)

FOREIGN PATENT DOCUMENTS

| | | |
|---|---|---|
| EP | 0 515 724 A1 | 12/1992 |

*Primary Examiner*—Jeanette Chapman
(74) *Attorney, Agent, or Firm*—Robert R. Deleault, Esq.; Mesmer & Deleault, PLLC

(57) ABSTRACT

A permanent form building assembly includes one or more GRC forms having a one or more open cavities and a reinforcement structure. The GRC forms are designed and configured for a predetermined application. The reinforcement structure is inserted within the open cavities of the GRC forms prior to filling with concrete.

12 Claims, 13 Drawing Sheets

U.S. PATENT DOCUMENTS

| | | | | |
|---|---|---|---|---|
| 4,398,378 | A | 8/1983 | Heitzman | |
| 4,646,495 | A | 3/1987 | Chalik | |
| 4,669,240 | A | 6/1987 | Amormino | |
| 4,987,719 | A * | 1/1991 | Goodson, Jr. | 52/742.14 |
| 5,103,604 | A | 4/1992 | Teron | |
| 5,678,373 | A | 10/1997 | Franklin et al. | |
| 5,924,254 | A | 7/1999 | Franklin et al. | |
| 6,101,779 | A | 8/2000 | Davenport | |
| 6,119,432 | A * | 9/2000 | Niemann | 52/797.1 |
| 6,256,960 | B1 * | 7/2001 | Babcock et al. | 52/592.1 |
| 6,385,933 | B1 | 5/2002 | Owens | |
| 6,457,281 | B1 | 10/2002 | Teron | |
| 6,721,684 | B1 * | 4/2004 | Saebi | 702/183 |
| 6,985,832 | B2 * | 1/2006 | Saebi | 702/189 |
| 2003/0041555 | A1 | 3/2003 | Scallan et al. | |

* cited by examiner

MODULAR SYSTEM OF PERMANENT FORMS FOR CASTING REINFORCED CONCRETE BUILDINGS ON SITE

BACKGROUND OF THE INVENTION

1. Field of the Invention

The present invention relates generally to building construction. Particularly, the present invention relates to a modular building assembly. More particularly, the present invention relates to a monolithic post and beam reinforced concrete structure using a system of permanent forms.

2. Description of the Prior Art

A common form of modern building construction is steel frame construction. Steel frame construction is relatively expensive due to the expense of the structural steel and the skilled labor involved. A less expensive method of construction is that of reinforced concrete construction. All reinforced building construction requires forms to mold the concrete into the different structural shapes required to carry the building loads. The forms create the voids where steel reinforcing rods are placed followed by filling with concrete in its fluid state, which is poured creating the structural components such as columns, walls, beams, floors, and roof slabs.

There are two distinct ways of building reinforced concrete structures with numerous combinations of both. There is conventional form making at the job site. In such construction, concrete forms are erected at the site, steel reinforcement rods placed in the forms, and concrete poured into the forms to create walls, load bearing columns, and floors of reinforced concrete. Upon curing of the concrete, interior and exterior facing panels are then secured to the outside surfaces, especially walls and floors, resulting in a reinforced concrete structure. This method still requires extensive amounts of on-site labor, which can be quite expensive when compared to factory labor.

A second way to build reinforced concrete structures is to prefabricate the components in a factory. Fabrication of construction components can be carried out at lower cost in a factory setting. This type of construction method is known as precast concrete structural components. This is accomplished by the manufacture of all or part of a structure at an off-site factory and then transporting the components to the site for assembly. The following prior art addresses various systems and methods for building structures utilizing precast concrete structures.

U.S. Pat. No. 1,469,955 (1923, Reilly) discloses using a plurality of wall blocks having recesses in their ends designed to form spaces when the blocks are set together for receiving concrete to form a plurality of columns. Some of the wall blocks have outer walls projected above the inner walls to form a seat on the inner wall for receiving a floor comprised of a plurality of tiles, slabs and a concrete floor interlocked with the slabs.

U.S. Pat. No. 1,757,077 (1930, Eiserloh) discloses building construction that includes a series of duplicate wall sections fashioned with staggered vertically extending openings. End edges of the tiles abut and middle portions therebetween are recessed. The opposed recesses define a duct or well and corner sections are L-shaped. A trough is permanently set along the tops of the wall sections. The troughs are provided with a series of definitely spaced apertures. Preformed beams are shaped to fit in the apertures. The beams support flooring and extend across parallel walls with their ends occupying a pair of aligned apertures.

U.S. Pat. No. 3,712,008 (1973, Georgiev et al.) discloses a modular building construction system in which prefabricated modules are supported on a separate framework, the individual members of the framework also being modular and prefabricated. The framework also defines vertical and horizontal passages required for utilities, corridors, elevators, etc. The prefabricated modules are generally constructed off the site and assembled together on the job during erection of the building.

U.S. Pat. No. 3,300,943 (1967, Owens) discloses a tilt-up building system for producing a monolithic construction. Prefabricated reinforced wall panels are tilted-up or raised to vertical positions of support upon vertical spacer members positioned upon a continuous footing at longitudinally spaced intervals. There are gaps between the panels and footings where reinforcing rods are positioned and secured. The gaps are then formed in to define voids and concrete is poured in to fill the void forming a reinforced concrete belt between the panels and footings. The forms are then removed from the panels and footings.

U.S. Pat. No. 4,081,935 (1978, Wise) discloses a building structure in which precast columns and beam and deck members are used. Upper columns are supported in spaced apart relationship to lower columns by pairs of rods extending from each column and clamped together. Topping concrete is poured to lock the members together into a unitary structure.

U.S. Pat. No. 4,127,971 (1978 Rojo, Jr.) discloses a building constructed of precast L-shaped concrete units. The precast L-shaped concrete units are obtained by utilizing reusable mold forms and casting the units vertically on a wheeled base between separable vertical mold forms. The concrete unit is transported on the wheeled base from between the separated molds to complete the curing. The building is erected on a concrete slab foundation using a plurality of precast concrete units in the form of L-shaped walls. H-beams are placed across the tops of the walls and filled with concrete to serve as a support and anchoring means for precast concrete roof slabs.

U.S. Pat. No. 4,343,125 (1982 Shubow) discloses a building block module and method of construction. Reinforced concrete building block modules are assembled into load bearing walls. The modules are configured as hollow rectangles having beveled corners with reinforcing rods extending through the side of the rectangle into the beveled spaces. The spaces are filled with concrete to form solid columns of reinforced concrete construction through which continuous reinforcing extends. The floors can be either poured or precast floor sections. The modules are erected into vertical walls that are integrated into a wall-floor system, whereby the walls support the building floors.

A disadvantage of the prior art regarding precast concrete structural components is that the structural systems depend on field point connections (e.g., welded steel plates, anchor bolts, post-tensioned cables, etc.). Building stresses concentrate at these field point connections, requiring redundancy in their design to avoid failure of the whole system in the event one connection fails. The design redundancy increases the use of materials and requires highly skilled labor, supervision and costly quality controls at the building site. The increased weight and size of these components requires costly transportation and expensive hoisting equipment. Another problem with these systems is sealing and waterproofing their joints, which is very costly and has to be replaced and maintained every 5 to 10 years increasing greatly the cost of the building.

A disadvantage of the prior art regarding conventional form making at the job site is that the construction methods are time consuming, require intensive skilled labor, exposure to weather conditions that affect scheduling and quality control of the forms, limited dimensional accuracy and wasteful in material consumption. Also, once the forms are stripped, the unfinished reinforced concrete surfaces require plastering or the use of other finishes like brick, tiles, stone, etc., unless expensive liners are used.

Therefore, what is needed is a reinforced concrete structure that provides for reductions in both the volume of concrete used and in the overall weight of the building. What is further needed is a reinforced concrete structure that provides for reductions in both steel reinforcement materials and in the labor for steel reinforcement. What is also needed is a reinforced concrete structure that provides reductions in both shoring and footing sizes. What is yet further needed is a reinforced concrete structure that provides reductions in forming (creating concrete forms), form removal and overall construction time. What is still further needed is a system that incurs a reduced transportation cost due to a reduction in weight of the precast concrete components. What is also needed is a reinforced concrete structure that provides for a reduction in capital costs, which are tied up in temporary forms, their installation, removal, care and storage. Finally, what is needed is a building of increased quality.

SUMMARY OF THE INVENTION

It is an object of the present invention to provide a modular system of permanent forms for constructing reinforced concrete buildings where the volume of concrete used and the overall weight of the building are reduced. It is another object of the present invention to provide for a reduction in steel reinforcement materials and in the labor required to assemble the steel reinforcement. It is a further object of the present invention to provide for a reduction in shoring and in footing sizes. It is still another object of the present invention to provide for a reduction of time required in forming (making concrete forms), form removal and overall construction. It is yet another object of the present invention to reduce transportation costs by reducing the weight of the precast concrete components. It is another object is to provide for a reduction in capital costs, which are tied up in temporary forms, their installation, removal, care and storage. Finally, it is an object of the present invention to increase the quality of the building.

The present invention achieves these and other objectives (1) by providing a relatively lightweight, prefabricated building component that is erected on site and reinforced with poured concrete and (2) by providing a prefabricated construction system for reinforced concrete buildings. The system employs a variety of precast glass-fiber reinforced concrete (GRC) components such as walls, flooring, roofs, columns, beams, etc. The system is amenable for use in a variety of construction projects, including but not limited to retaining walls, above grade walls, and reinforced concrete buildings. The system is assembled over footings and/or a foundation. For reinforced concrete buildings, a foundation is made up of a concrete floor slab with the periphery depressed or stepped to receive precast GRC wall panels. The depressed or stepped periphery minimizes mechanically the infiltration of water into the structure.

The GRC components are made of a concrete material that is made up of a slurry of cement and sand with AR fibers, which give this matrix a high flexural strength. The high flexural strength of the material allows it to be used for secondary structural loads with a typical thickness of about ⅜ inches and weighing typically 4 to 5 pounds per square foot. Because of the material's high density, forms made with the typical thickness disclosed previously are impervious. Further the material's high density also allows for a reduction in the thickness of the concrete required for the protection of steel rods of the primary structural components cast on site. The relative thinness of the GRC coupled with its strength allows for the formation of very strong and lightweight precast forms that reduce the amount of the temporary shoring compared to conventional precast concrete forming techniques. In addition, the forms are fireproof. With respect to GRC components used for retaining walls, above grade walls, support beams, support columns, and the like, the lightweight components are assembled on site and serve as the permanent forms for receiving poured concrete.

For use in constructing buildings, the present invention includes pre-cast GRC wall components or panels having a top and bottom perimeter, a first and second vertical perimeter, and includes either a single skin wall or a double skin wall. The wall panel top perimeter is typically U-shaped for receiving steel reinforcement and poured concrete. The wall panel top perimeter can be configured in different shapes other than U-shaped and still be suitable for its intended purpose so long as the top perimeter is open. The top perimeter may optionally have a top perimeter portion that mates with a bottom perimeter mating portion of the bottom perimeter.

The first and second vertical perimeters typically have flanges that project out of the plane of the inside face of the wall panel such that, when assembled with other wall panels, form a space or void between adjacent wall panels that is in communication with the U-shaped top perimeter of the wall panel. The wall panels have in their exterior vertical perimeters a wall panel mating connection that mates adjacent wall panels together. The wall panel bottom perimeter optionally has a lip on the outside face to overlap the exterior face of the top perimeter of another wall panel or the foundation floor slab to minimize, mechanically, water penetration into the building. Column steel reinforcements are placed into the voids and a GRC enclosing panel is installed between flanges of adjacent wall components enclosing the voids, which are to receive the concrete to form the building support columns. The wall components/panels come in a variety of shapes and sizes, have numerous configurations involving the location of precast openings for doors, windows, air conditioning/heating components, etc., or may be devoid of precast openings.

After the concrete has been poured into the column voids to stabilize the walls, steel reinforcements for the beams are placed into the U-shaped top perimeter of the pre-cast GRC wall panels. Pre-cast GRC floor or roof panels are then placed on top of the interior side of the top perimeter of the wall panels, spanning the interior sides of the wall panels, forming an enclosed room space. Pre-cast GRC floor panels of the present invention typically have a width of 8 feet with two U-shaped ribs between typically three hollow core regions. The U-shaped ribs may be of varying width and height depending on the loads and spans and are spaced 2 feet 8 inches on center. The floor panel preferably includes L-shaped edges to accommodate easier fitting and assembly. The pre-cast GRC floor panels can vary in length up to 50 feet. The hollow core regions are about 7 inches high by 26 inches wide allowing for the installation of electrical wiring, piping, ducts, etc. By using GRC components, the present invention's floor panel typically weighs an average of 12 pounds. The prior art has a hollow core of about 4 inches and weighs about 52 pounds.

Steel reinforcements are placed in the U-shaped ribs. Concrete is then poured over the U-shaped ribs and beam voids to create a monolithic structure bounding integrally the walls with the floor. The pre-cast GRC floor panels of the present invention are used as permanent formwork for floor slabs and roofs on top of which a concrete toping is poured in place especially when the concrete is poured over the U-shaped ribs and beam voids. Depending on the building configuration, additional floors can be constructed in the same manner as the ground floor. In multistory buildings, finishing work to the interior of the building can be accomplished while additional floors are constructed. Interior wall panels, if required, are attached to the precast panel. Doors and windows as well as the wiring for electrical service can also be installed.

The present invention, which uses pre-cast GRC components as permanent forms for casting reinforced concrete buildings, retaining walls, etc., on site, has several distinct advantages over the prior art. Use of the present invention system particularly for building construction provides (1) a reduction in the volume of concrete by about 20 to about 30%, (2) a reduction in the use of steel reinforcement materials by about 10% to about 15%, (3) a reduction in labor for installation of the steel reinforcement by about 30% to about 45%, (4) a reduction in shoring by about 20% to about 30%, (5) a reduction in the overall weight of the building by about 20%, (6) a reduction in footing sizes and steel reinforcement by about 10% to about 20% (depending on building height and weight), (7) a reduction in labor time of about 20% to about 40% for formwork and form removal, and (8) a reduction in the amount of working capital tied up in temporary forms, their installation, remove, care, and storage.

All of the present invention's advantages, which are only traditionally attributed to steel structures, become part of the present invention and is better than steel because the components of the present invention do not require fireproofing and do not corrode.

DETAILED DESCRIPTION OF THE PREFERRED EMBODIMENT

Figure 1:
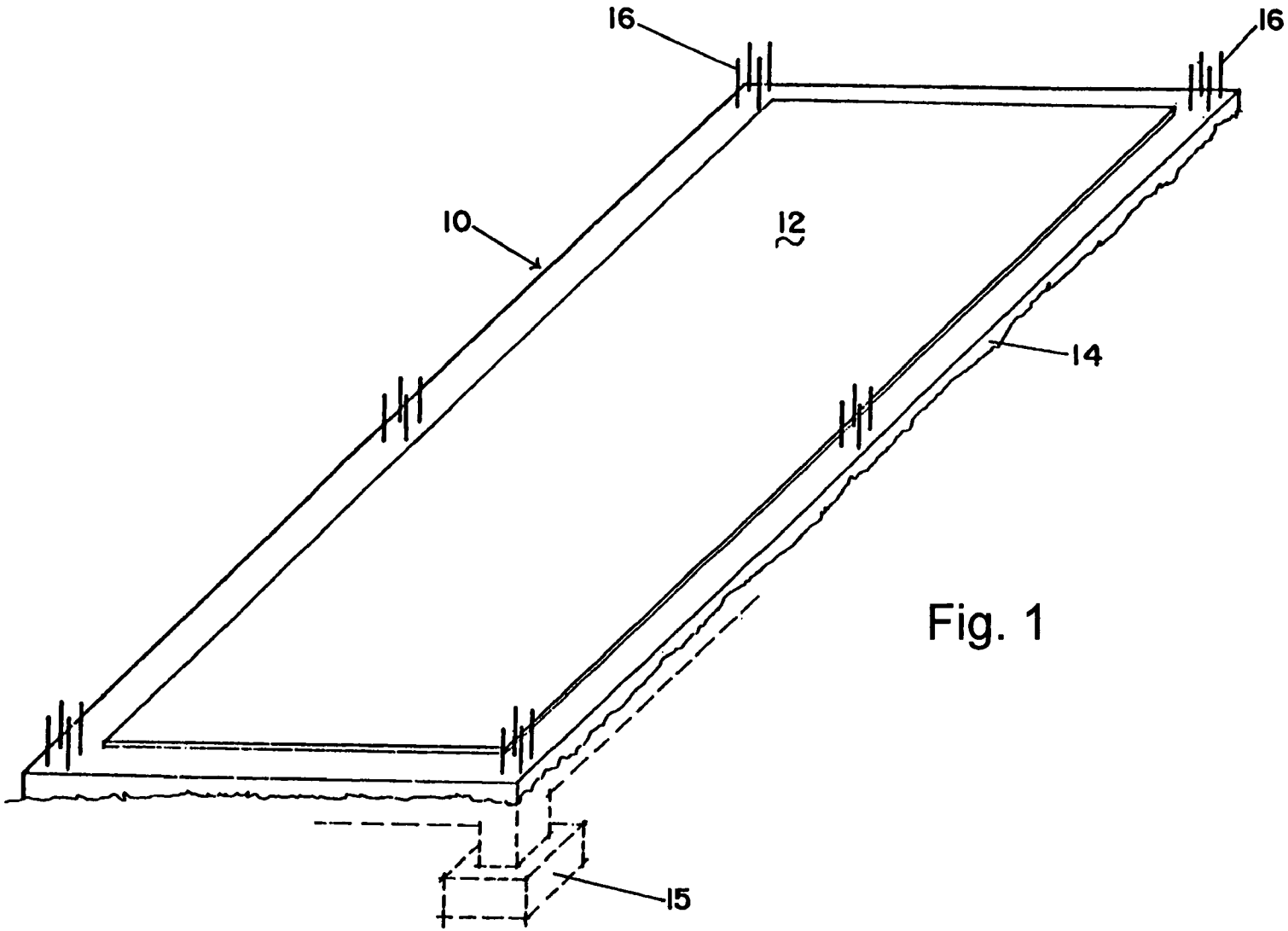
FIG. 1 is a perspective view of one embodiment of a foundation of the present invention.

The preferred embodiment(s) of the present invention is illustrated in FIGS. 1–14. FIG. 1 illustrates a foundation 10 made up of a concrete floor slab 12 supported by a plurality of building footings below ground and represented by reference 15. The periphery 14 of concrete floor slab 12 is depressed or stepped to receive one or more pre-cast GRC wall panels (not shown). The depressed/stepped periphery 14 is designed to minimize mechanically the infiltration of water into the structure. Steel dowels 16 are installed at locations where building support columns will be formed. Steel dowels 16 are installed using a template to insure their precise location and arrangement.

Figure 2:
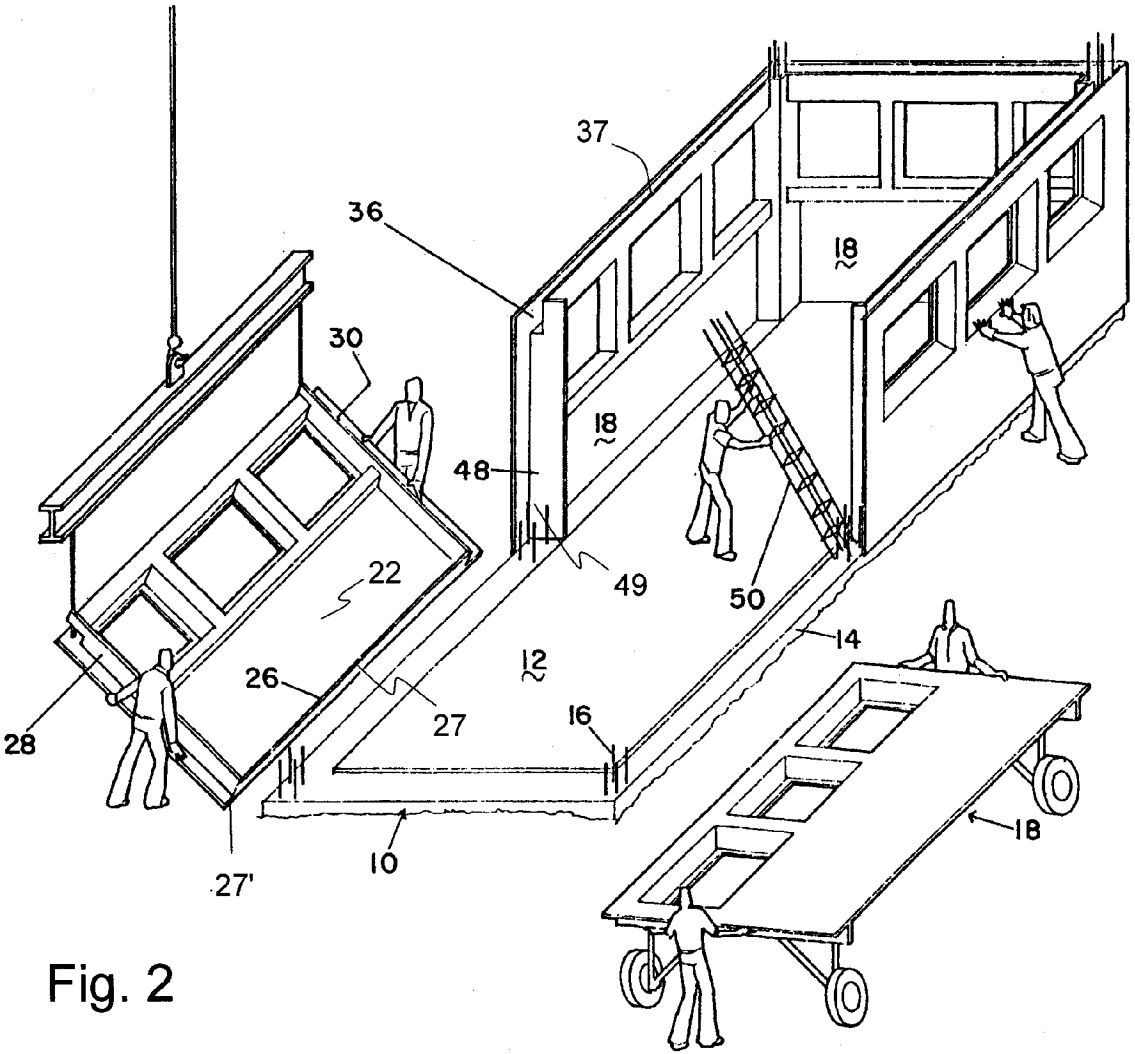
FIG. 2 is a perspective view of the present invention showing erection of the ground floor walls.

FIG. 2 illustrates assembly of the ground floor of a building using the construction system of the present invention. A plurality of pre-cast GRC wall panel 18 is assembled over foundation 10. Pre-cast GRC wall panel 18 includes a top perimeter 36, a first and second vertical perimeter 28 and 30, a bottom perimeter 26, and an exterior and interior side. The wall panel top perimeter 36 is preferably U-shaped creating a void or channel 37. The U-shaped channel is typically 6 inches deep by 12 inches wide. A person of ordinary skill in the art will realize that the wall panel top perimeter 36 may be shaped other than U-shaped and still be suitable for its intended purpose within the system of the present invention.

First and second vertical perimeters 28, 30 have flanges 48 that project out of the plane of the inside surface 22 of wall panel 18. When two wall panels 18 are assembled adjacent each other, flanges 48 form a column void 49 where the building support columns are formed. The voids are typically 6 inches by 24 inches. The wall panel bottom perimeter 26 has preferably a bottom surface 27 and a lip 27' on the outside face to overlap exterior vertical edge of floor slab 12 to mechanically prevent water filtration into the building. Pre-cast GRC wall panel 18 may have a variety of shapes and sizes, have numerous different configurations involving the location of precast openings for doors, windows, etc. or may be devoid of precast openings. As illustrated, a plurality of pre-cast GRC wall panels 18 are moved to the building site and then erected in place. Column steel reinforcement 50, which is an assembly of concrete reinforcing rods and/or screens, is positioned in the voids created by flanges 48 of adjacent wall panels 18.

Figure 3:
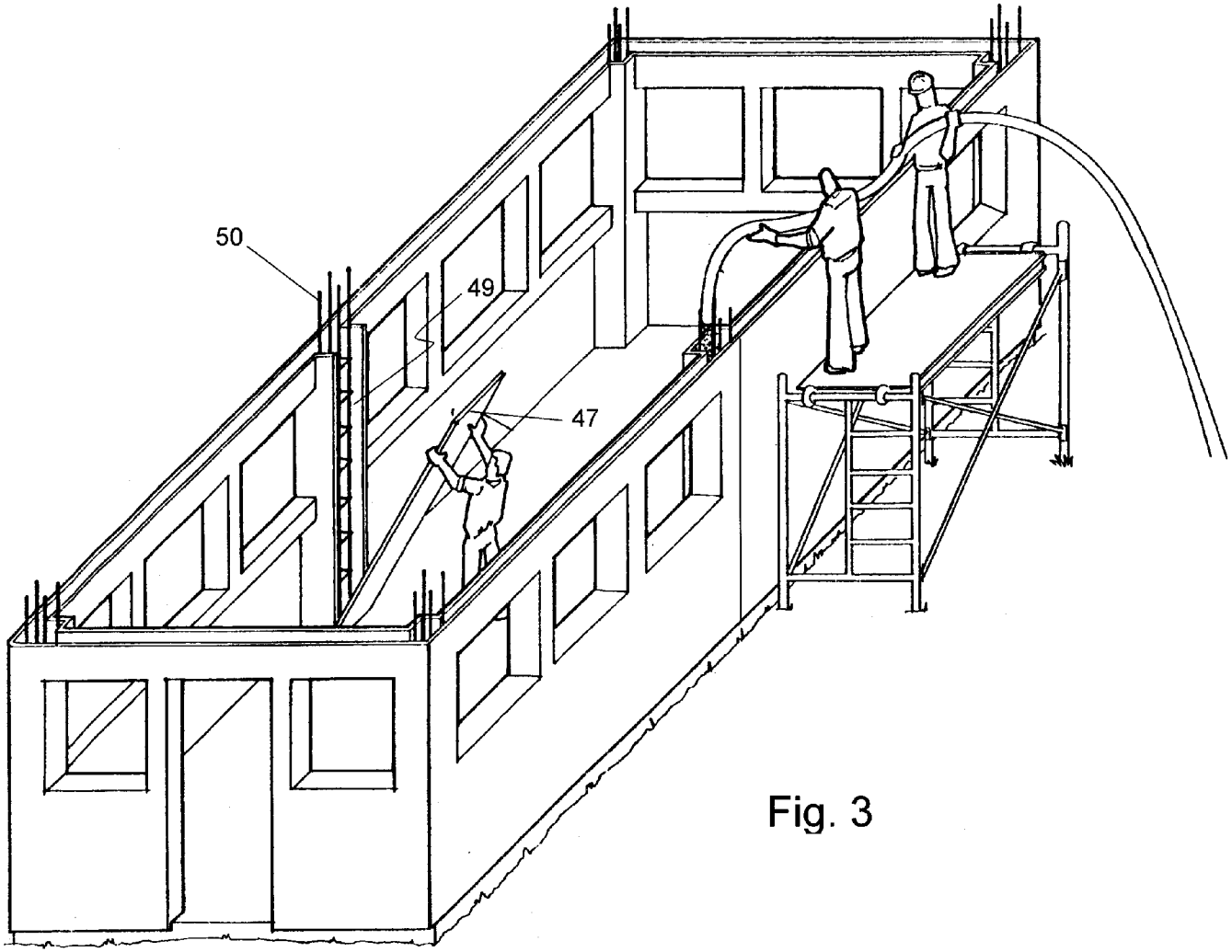
FIG. 3 is a perspective view of the present invention showing the formation of the support columns for the building.

FIG. 3 illustrates finishing of the erection of the precast GRC wall panels 18 on the ground floor. A GRC form 47 is installed to enclose column void 49 between two precast GRC wall panels 18. Fluid concrete for the columns is then poured into column void 49, which contains column reinforcement 50, forming reinforced support columns and temporarily stabilizing all of the walls.

Figure 4:
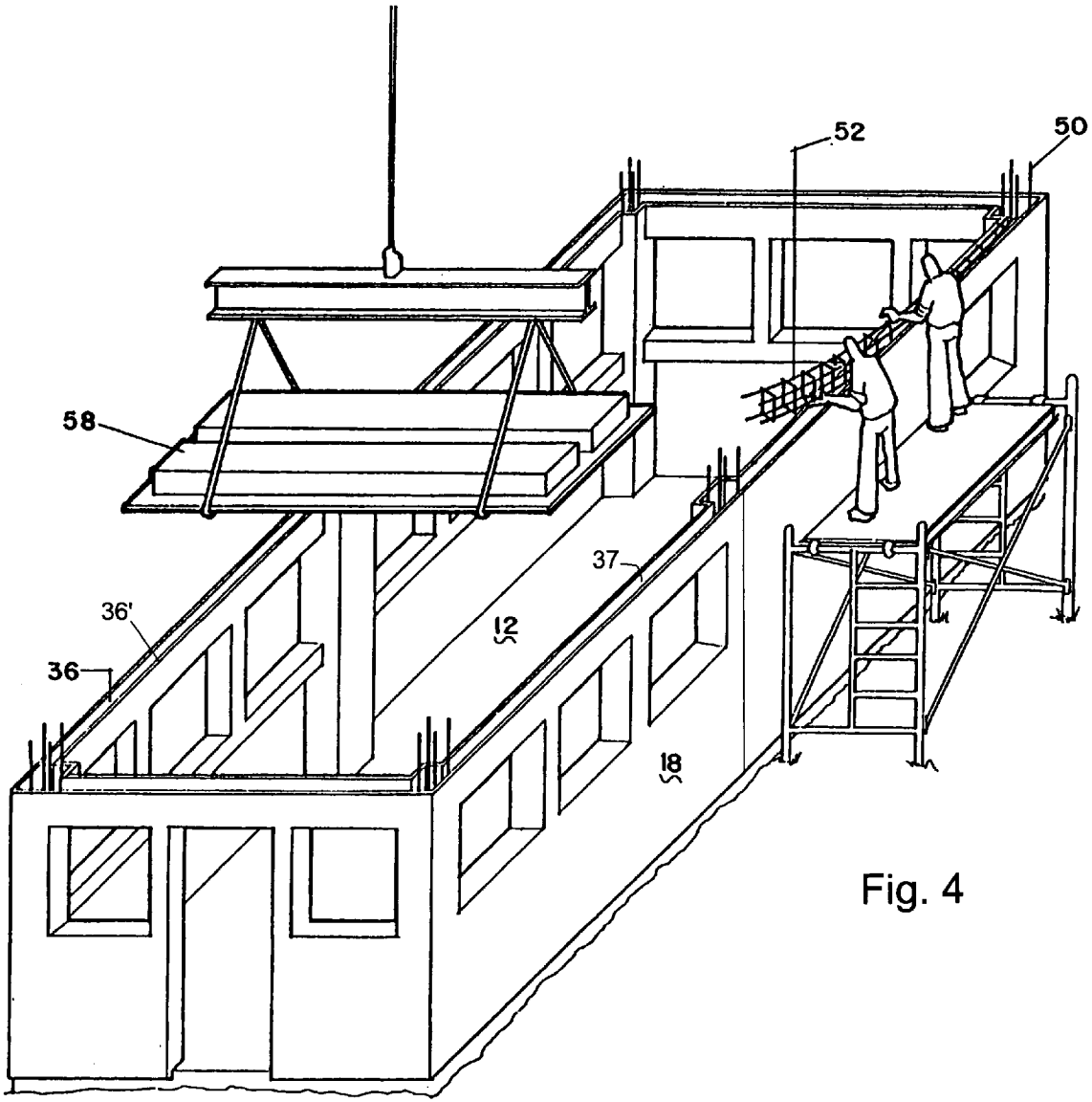
FIG. 4 is a perspective view of the present invention showing placement of the steel reinforcements for the beams and installation of the pre-cast floor or roof GRC panels.

Turning now to FIG. 4, continued construction of a building according to the teachings of the present invention is illustrated. Steel reinforcement 52 is placed into top perimeter channel 37 of each wall panel 18 once all the columns have been filled with the fluid concrete. Pre-cast floor or roof GRC panels 58 are positioned on top of the interior side 36' of the top perimeter 36 of wall panels 18, spanning the interior sides of the wall panels forming an enclosed room area.

Figure 5:
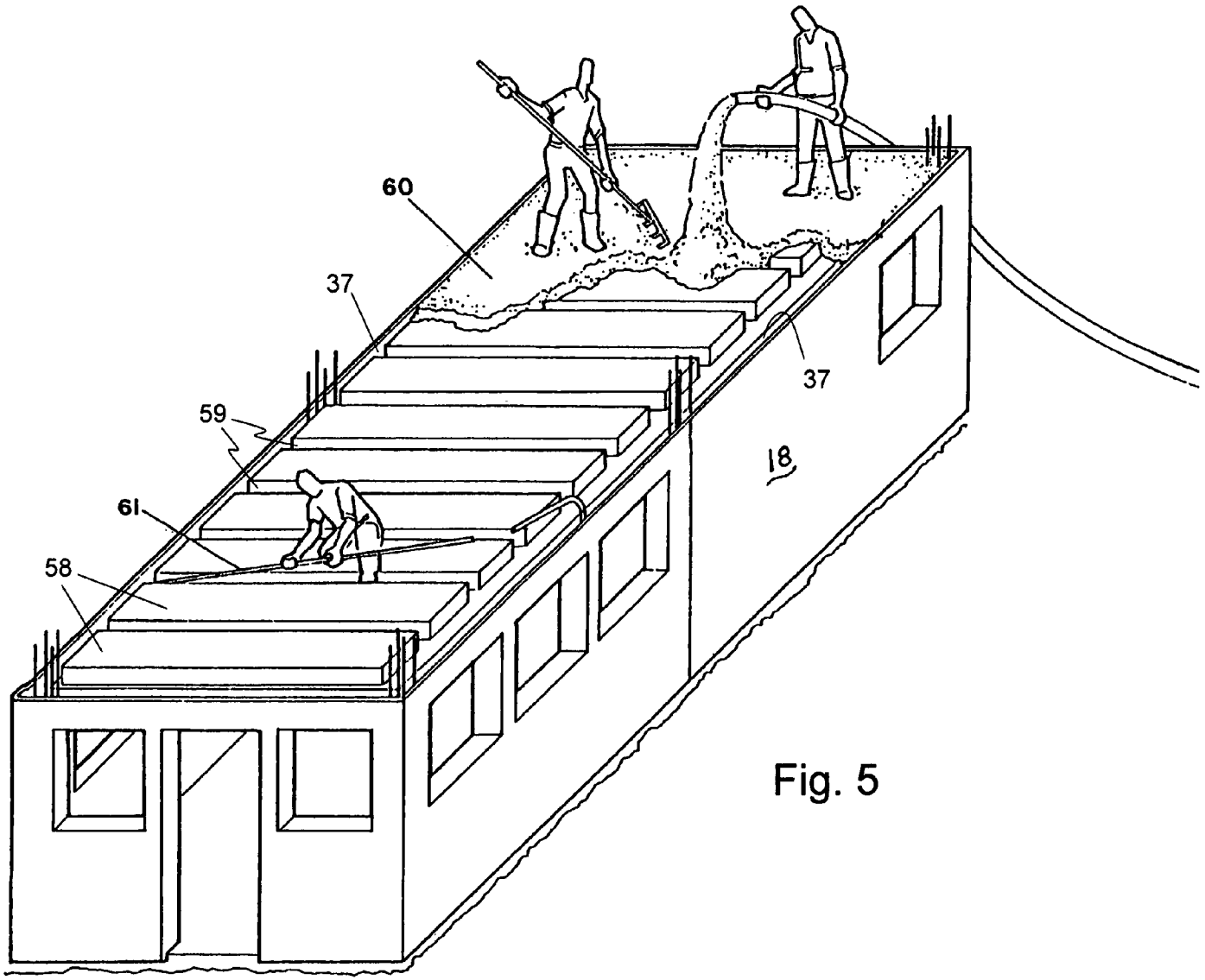
FIG. 5 is a perspective view of the present invention showing placement of steel reinforcements on the pre-cast GRC floor panels and the pouring of concrete to create a monolithic structure.

FIG. 5 shows all of the pre-cast floor or roof GRC panels 58 installed over wall panels 18. Steel reinforcement 61 is placed into the floor voids 59 of the permanent GRC floor or roof panels 58. Fluid concrete 60 is then poured over the GRC floor/roof panels 58 and the top perimeter channel 37 to create a monolithic structure bounding and supporting integrally the walls with the floor/roof, thereby forming floor slab 59'.

Figure 6:
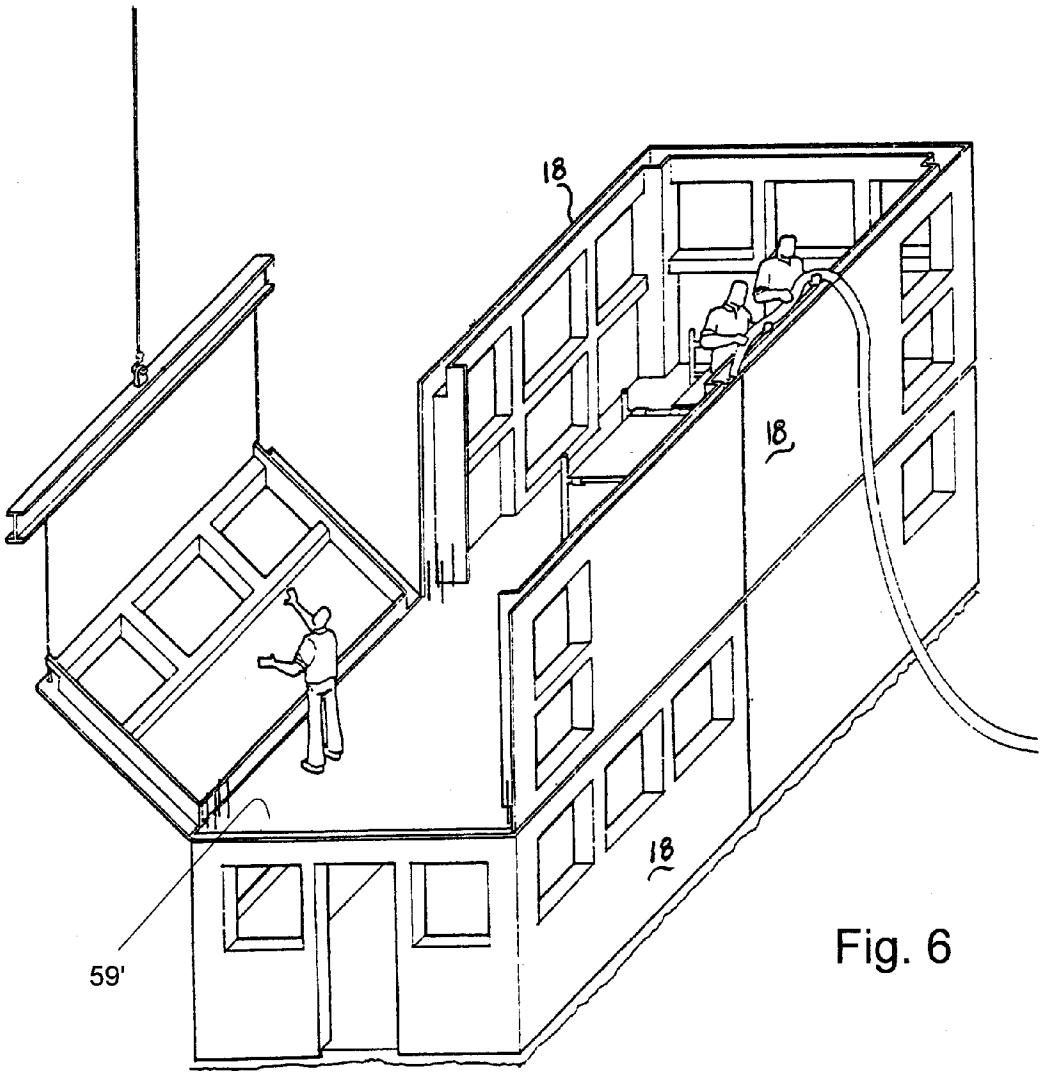
FIG. 6 is a perspective view of the present invention showing construction of an additional floor in the same manner as the ground floor.

Tuning now to FIG. 6, continued construction of a second story/level of a building according to the teachings of the present invention is illustrated. A plurality of wall panels 18 is assembled over the perimeter of the floor slab 59' to add an additional floor to the building. The assembly of wall panels 18 is performed in the same manner as previously explained by forming the support columns, placing steel reinforcement within the column voids and pouring the liquid concrete into the column voids. If a shaped roof panel is intended to be used to cover the second floor, then typically steel reinforcement is place into the top perimeter channels 37 and fluid concrete is poured into top perimeter channels 37 before the roof panels are attached.

Figure 7:
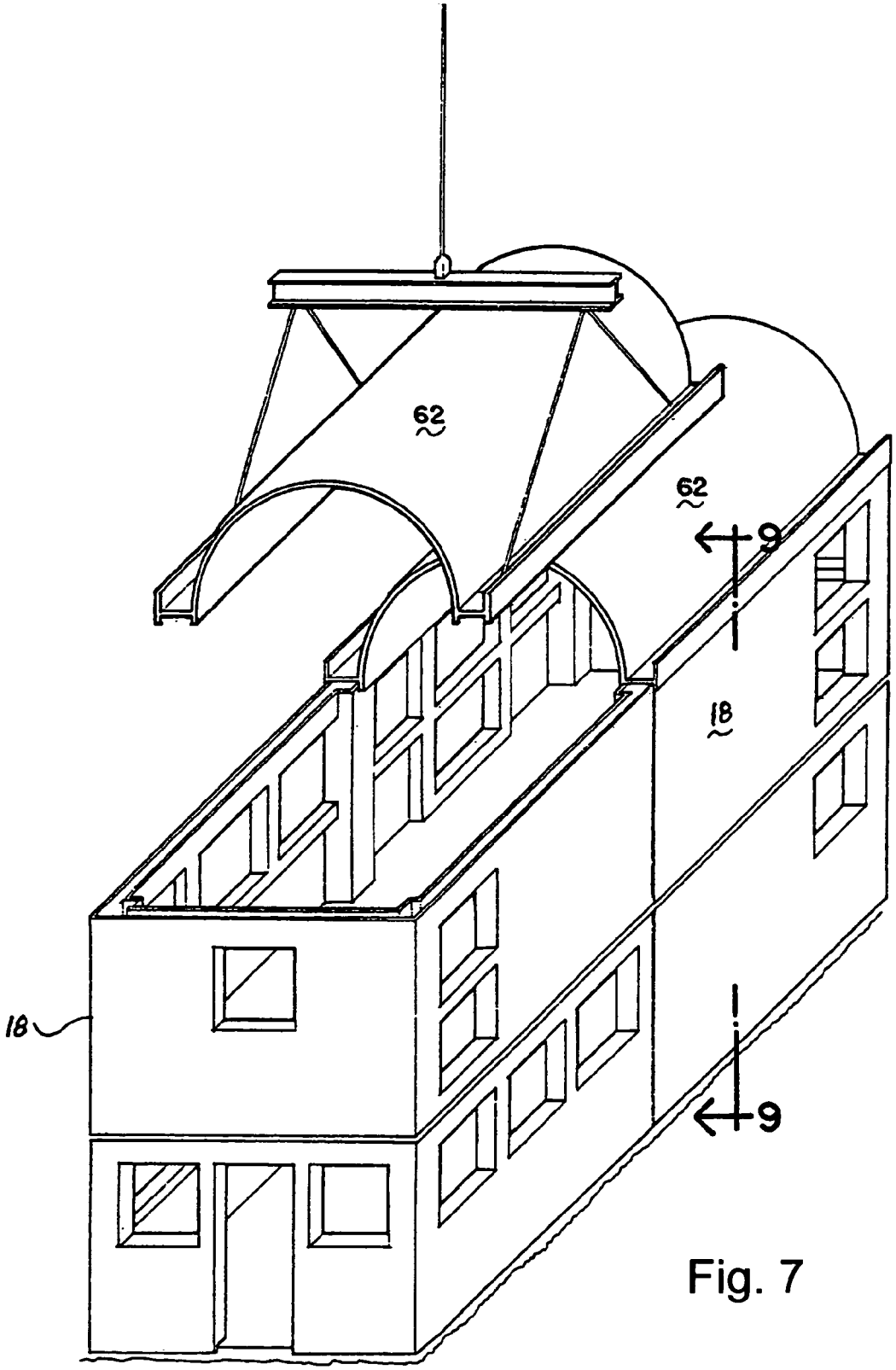
FIG. 7 is a perspective view of the present invention showing installation of a GRC roof panel.

FIG. 7 illustrates the assembly of a shaped GRC roof to the structure. After the top perimeter channels 37 have received the fluid concrete, one or more shaped GRC panels 62 are installed on top of the pre-cast GRC wall panel 18. Although an arched or vault roof is illustrated, roof panels may have any shape.

Figure 8:
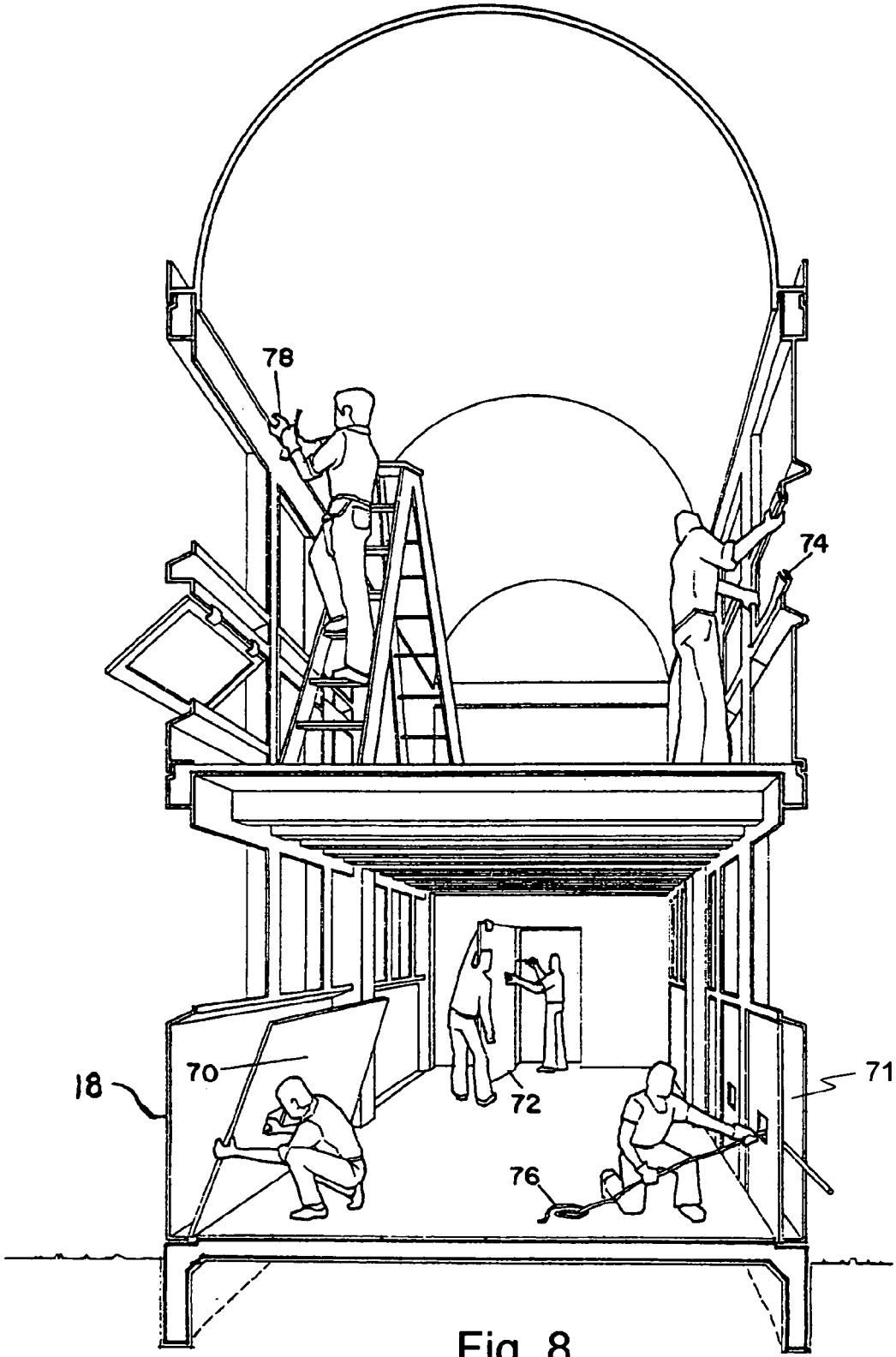
FIG. 8 is a cross-sectional, perspective view of the present invention showing finishing work being done to the interior of the structure.

FIG. 8 illustrates a building construction where the wall panels 18 are single skin wall panels. In such a construction, interior wall panels 70 may be attached to wall panel 18 forming a wall space 71. Doors 72 and windows 74 can now be installed. Preferably, the door frames and window frames are installed at the plant where the pre-cast GRC wall panels 18 are manufactured and the doors and windows are installed on-site. The windows may be installed in the wall panels 18 while at ground level before the wall panels 18 are assembled to the foundation 10 or floor slab 59'. Wiring 76 for electrical service can also be installed within wall space 71 as well as plumbing where kitchens, bathrooms, laundry rooms and the like are intended. Preferably, electrical conduits and boxes are factory installed for cost savings and ease of use at the building site. The roof panel connection 78 with the top perimeter 36 of wall 18 can also be adjusted at this time.

Figure 9:
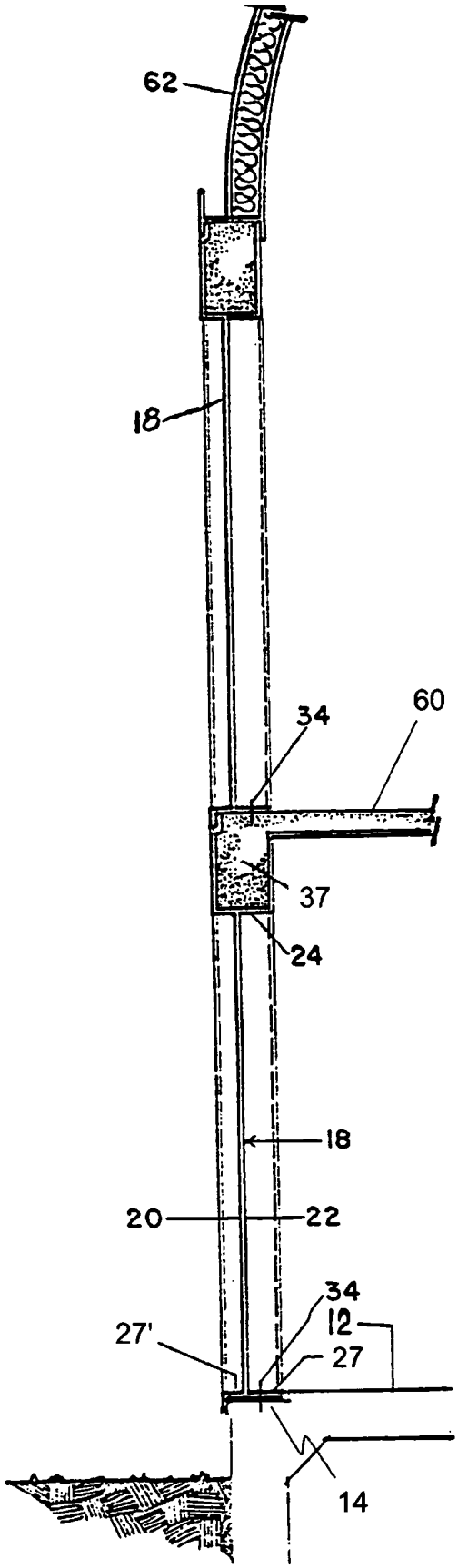
FIG. 9 is a cross-sectional view of a side of the present invention showing the foundation, floor slab, ground floor and additional floor GRC wall panels, and a GRC roof panel.

FIG. 9 illustrates a cross-sectional side view of the construction system. The floor slab 12 is shown with a depressed/stepped perimeter 14 upon which is positioned a wall panel 18. The depressed/stepped perimeter 14 in conjunction with wall bottom surface 27 prevents water infiltration. Temporary connection 34 is optionally used to temporarily stabilize wall panel 18 until concrete beam and floor slab topping 60 is cast on site. Wall panel 18 has an exterior and interior side 20, 22, respectively, a lip 27' on the exterior bottom of wall panel 18 to mechanically prevent water infiltration, and the U-shaped structure 24 which forms the top perimeter channel 37 where the steel reinforcement is installed and the concrete is poured forming a reinforced beam. The GRC vault roof panel 62 is shown as a two skin panel with factory installed rigid insulation. Roof panel 62 may also include factory installed electrical boxes and solar panels.

Figure 10:
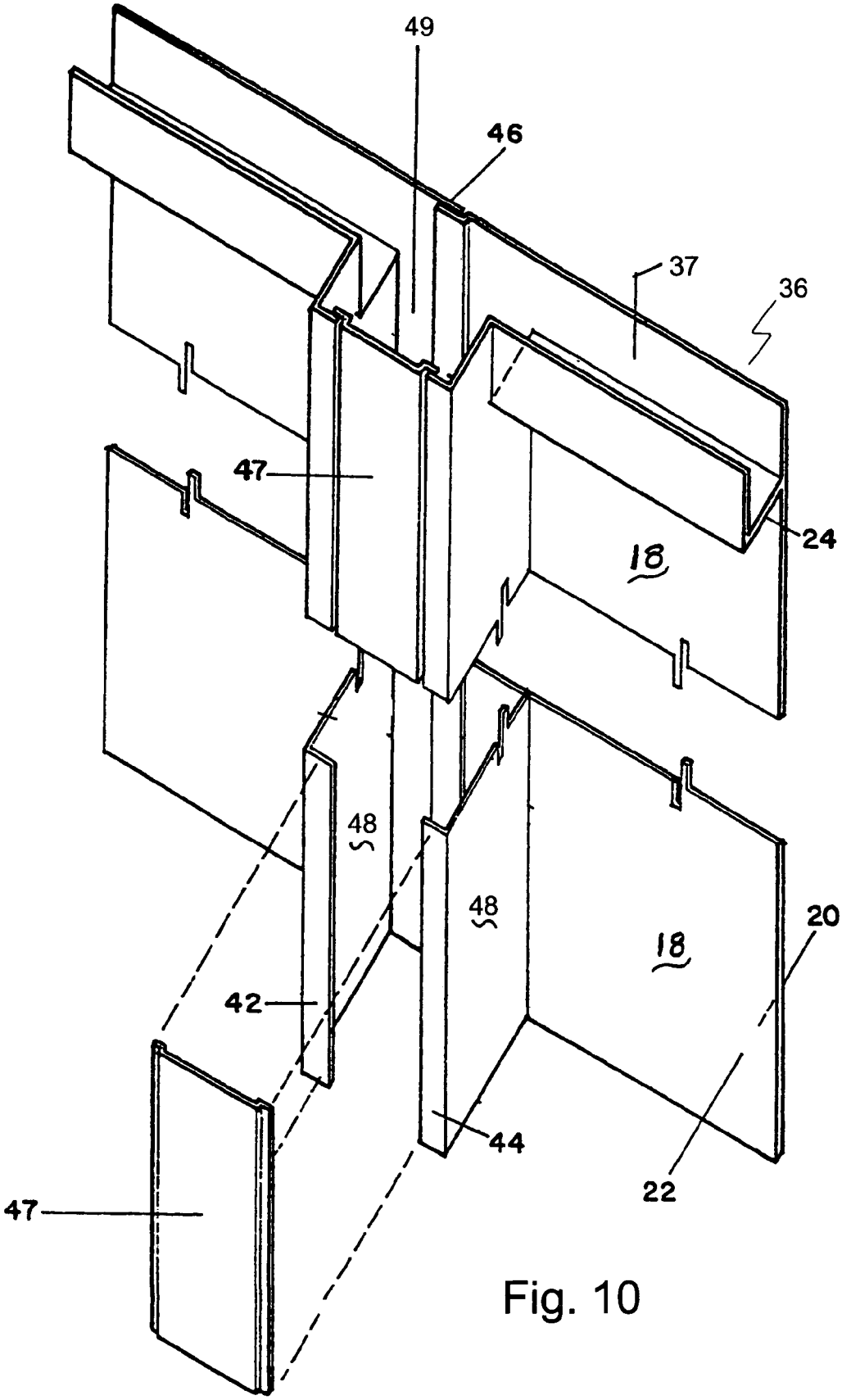
FIG. 10 is a perspective view of a pre-cast GRC wall panel showing the mating ends of a pre-cast GRC wall panel forming a void where the support columns are formed.

FIG. 10 illustrates an enlarged perspective view of the wall panel of the present invention. In this view, the top half of wall panel 18 is separated from the bottom half in order to illustrate one useful embodiment of the flanges and GRC form panel. The GRC pre-cast wall panel 18 has an exterior side 20 and an interior side 22. In this embodiment, the wall panels 18 have an overlapping connection 46 that mates adjacent wall panels together. The top perimeter 36 of wall panel 18 has a U-shaped top structure 24 that creates a void, channel or beam form 37. Also shown is the interior side of the flanges 48 with rough finish for adherence with poured on site concrete. The wall panels have vertical perimeter flanges 48 with vertical flange edges 42 and 44 that mate with the vertical edges of GRC form 47 creating column void 49 where column steel reinforcements are positioned before fluid concrete is poured to form a support column.

Figure 11B:
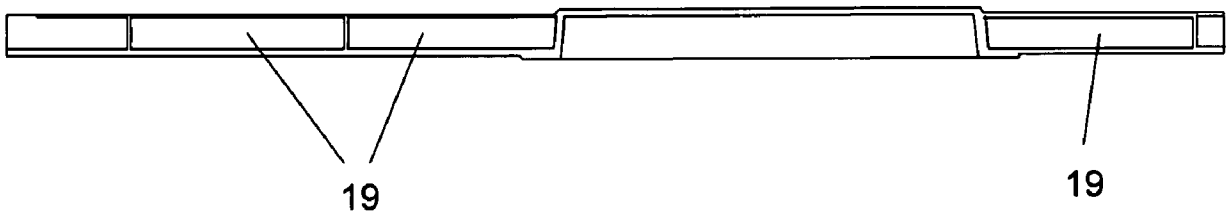
FIGS. 11A and 11B are cross-sectional side and top views, respectively, of another embodiment of a GRC wall panel of the present invention.
Figure 11A:
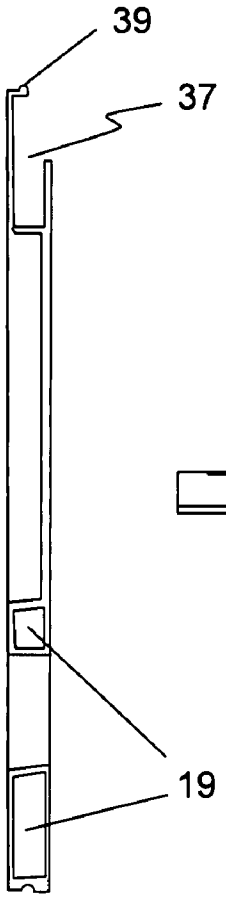

FIGS. 11A and 11B illustrate cross-sectional views of another embodiment of a wall panel. In this configuration, wall panel 18 has a double skin of GRC material with an air space 19 that serves as air insulation. To create an active air insulation, an opening (not shown) in the bottom and top of the wall panel 18 provides for a thermo siphon, which causes air in panel air space 19 to flow up to cool the inner surface of the wall in summer. In winter, the openings are closed to minimize cooling of the inner surface. Conventional insulation may optionally be installed in wall panel 18. In addition, top wall perimeter 36 has mating joint 39 that mates with bottom wall surface 27.

Figure 12A:
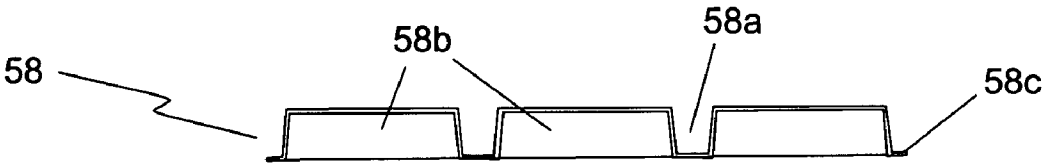
FIGS. 12A and 12B are cross-sectional end and side views of another embodiment of a floor/roof GRC panel.
Figure 12B:
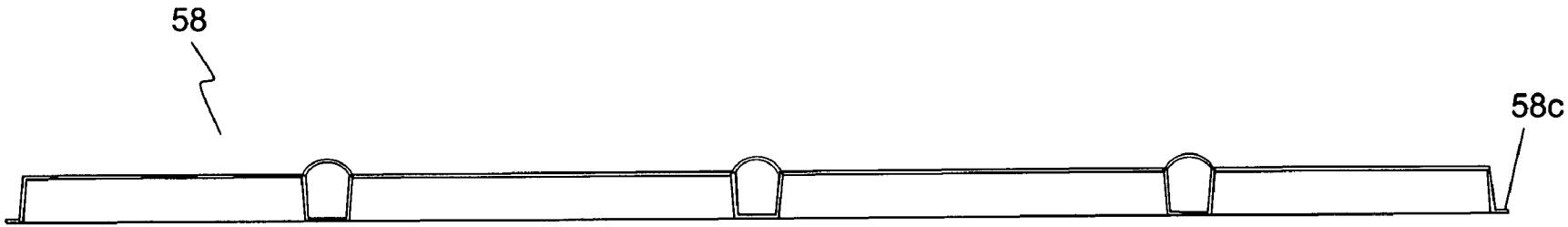

FIGS. 12A and 12B illustrate end and side plan views of a pre-cast GRC floor panel 58. Pre-cast GRC floor panel 58 typically has a width of 8 feet with two U-shaped ribs 58*a* between typically three hollow core regions 58*b*. U-shaped ribs 58*a* may be of varying width and height depending on the loads and spans and are spaced 2 feet 8 inches on center. Floor panel 58 preferably includes L-shaped edges 58*c* to accommodate easier fitting and assembly. Pre-cast GRC floor panel 58 can vary in length up to 50 feet. Hollow core regions 58*b* are about 7 inches high by 26 inches wide allowing for the installation of electrical wiring, piping, ducts, etc. By using GRC components of the present invention, floor panel 58 typically weighs an average of 12 pounds. The prior art has a hollow core of about 4 inches and weighs about 52 pounds. As previously disclosed, the pre-cast GRC floor panels of the present invention are used as permanent formwork for floor slabs and roofs on top of which a concrete toping is poured in place.

Figure 13:
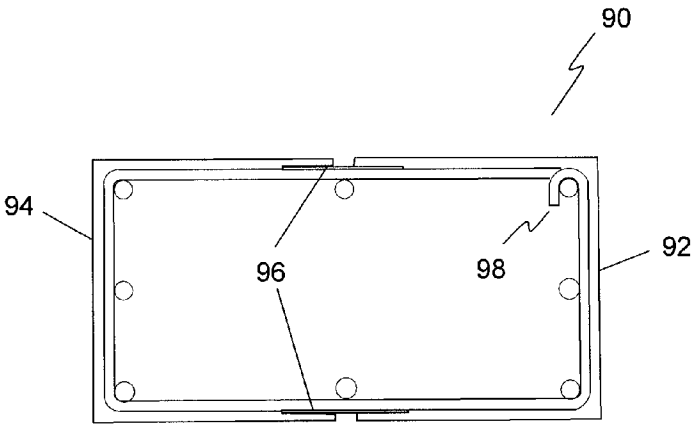
FIG. 13 is a top cutaway view of a permanent formwork column.

FIG. 13 illustrates a cross-sectional view of a pre-cast GRC column 90 using the permanent formwork of the present invention. Pre-cast GRC column 90 includes a first column form 92, a second column form 94, a connecting plate 96, and reinforcing framework 98. Preferably, the components of pre-cast GRC column 90 are shipped to the job site for assembly. First column form 92 and second column form 94 surrounds reinforcing framework 98 and are held in position by connecting plate 96. Once assembled and positioned into place, pre-cast GRC column 90 is filled with fluid concrete.

Figure 14:
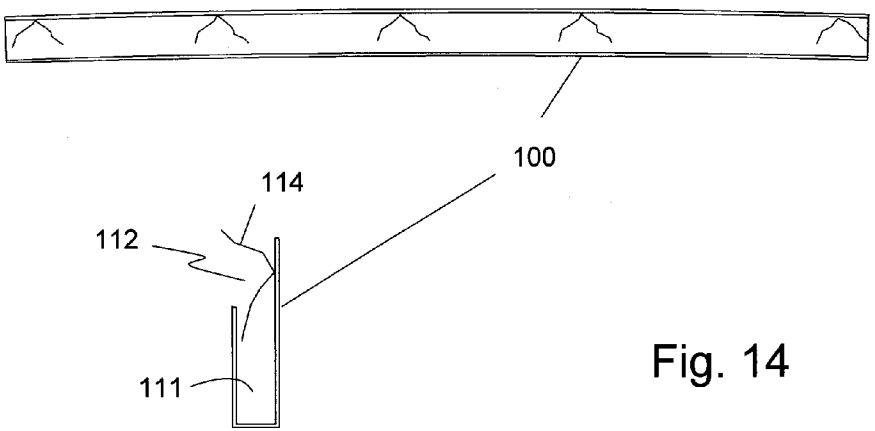
FIG. 14 are plan views of the "U" shaped beam form.

FIG. 14 illustrates a cross-sectional view of a pre-cast GRC beam 110 using the permanent formwork of the present invention. Beam 110 is typically U-shaped with an open top 112. Steel reinforcement rods 114 are positioned within beam cavity 111 of beam 110 and the fluid concrete is then poured into beam cavity 111. GRC beam 110 may be straight, curved, arched, or irregular shaped as long as top 112 is open.

It is important to note that that the permanent GRC form system of the present invention provides for a strong, yet lightweight, prefabricated form that reduces the amount of temporary shoring required compared with conventional forming techniques. The permanent GRC form system of the present invention provides for an unlimited use where concrete forming is required. For example, a retaining wall permanent form may be made with varying wall thickness, depending on the wall height and structural soil conditions. The retaining wall permanent form would include rectangular voids of varying dimensions that are space on 2 feet eight inch centers with U-shaped vertical edges and a U-shaped top edge. Reinforcing steel similar to that previously described is placed within the voids and fluid concrete is poured into the voids creating a continuous post and beam reinforced concrete retaining wall.

With regard to the wall panels, once the concrete is poured on site, the structural connection between the wall panels also becomes the structural connection between panels without requiring any connectors. In addition, this method provides a waterproof joint without the need for sealants.

Although a basic flat floor and/or flat roof slabs were described, it should be noted that these GRC components may be constructed as a sandwich panel having a bottom (i.e., ceiling) finished surface and a top surface the two U-shaped ribs previous disclosed. The floor/roof panels may include electrical and mechanical components factory installed.

The use and installation of the present invention reduces labor by about 40% to about 60%. This is achieved because skilled labor is not required for installation since only the forms need to be properly positioned, unlike conventional techniques that require point connections to weld or bolt, or cable post tensioning, etc. Only a minimal amount of bracing (about 70% less than is used with standard pre-cast reinforced concrete panel installation) is required to hold the wall panels or column forms in place temporarily while the steel reinforcement is placed in the voids and the concrete poured. Further, the next day floor or roof panels are positioned and minimal shoring is required (about 70% less than conventional shoring). Because no forms need to be removed, these operations can be repeated the next day while the concrete of the previous day cures. Under ideal conditions, the present invention enables a full building floor to be cast/erected in two days. This system makes it competitive with steel structures with regard to time, especially since steel structures later require fireproofing and the enclosing of the exterior walls with other panels.

Due to the lightness of GRC material, a single skin, one-half inch thick wall panel with 5 inch by 12 inch top horizontal and vertical channels in its perimeter averages 6 pounds per square foot against 50 pounds per square foot for a 4-inch pre-cast reinforced concrete panel. For a 6-inch thick hollow double skin panel, with the same channels as the single skin panel, its average weight is 12 pounds per square foot against 75 pounds per square foot for a 6-inch thick pre-cast reinforced concrete panel. The GRC panel weighs about 6 times less than the conventional pre-cast panel. Translating this into transportation costs, a typical 8 foot wide×45 foot long trailer platform with a net maximum load of 60,000 pounds is cable of transporting 5,000 square feet of 6-inch thick GRC panels while it is only capable of transporting 800 square feet of 6-inch thick conventional pre-cast concrete panels, 6.25 times less.

This weight difference is also reflected in the hoisting capacity requirements, fuel consumption, ease of handling and installation and the total weight of the building which in turn reduces the size of all the structural members including foundations. This is a very relevant safety fact in earthquake zones, where the lighter the building the better its performance.

In terms of construction time, this is reduced as much as 40% depending on the building type, size and site conditions and design. In high rise construction, computer simulations have shown that a 55% time reduction may be achieved by enclosing simultaneously the exterior walls of the building with the construction of its supporting structure since interior work may be performed two or three floors below the one being installed. Following this construction protocol reduces dramatically the time required by the typical linear sequence of conventional construction, both in reinforced concrete and steel structures. This reduction in time reduces the builders overhead, which reduces the interim financing costs and the capital required for a given project.

The buildings built with the prefab permanent form system of the present invention achieves a better building by transferring the most difficult activities within the controlled environment of a manufacturing plant. All the subsystems are installed in the prefab permanent forms increasing the quality of the finishes and avoiding much of the typically uncontrolled environment of a building site. For example, the installation of the windows in a high rise building, if installed in the factory or in the ground floor of the site prior to hoisting the panel accomplishes in one operation the hoisting of the panel and the window which regularly is done separately. It is more efficient since all the window installers are in one place, which eliminates the time spent going up and down the building. Further, working in the factory or in the ground floor of the building site is safer than installing and caulking the windows from the outside of the building, which is done up in the air and requiring the use of expensive scaffolding or motorized equipment. The quality control of the window assembly is made in the factory or the ground floor of the site prior to erecting the panel, thus avoiding costly repairs of the windows once up on the building.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A permanent form building assembly comprising:

a supporting foundation, defining a floor and an outer perimeter of a building;

a plurality of vertically disposed, lightweight, pre-cast GRC wall panels supported on said foundation and together forming a first enclosure of said building at said perimeter, each of said wall panels comprising:

a top edge having an open channel;

a bottom surface; and two side edges wherein each side edge has a flange that defines a space between said flange and said side edge and wherein said side edge and said flange of adjacent wall panels defines a column void that is in open communication with said open channel;

a column void enclosing panel between linearly adjacent wall panels;

a plurality of reinforcing bar structures disposed within said open channels and said column voids;

one or more pre-cast GRC floor panels disposed over said enclosure formed by said plurality of GRC wall panels; and concrete disposed over said one or more floor panels and into and filling each of said open channels and said column voids forming an integral building support.

2. The assembly of claim 1 further comprising a second enclosure of said wall panels disposed above said first enclosure.

3. The assembly of claim 1 wherein said wall panels have an integrated seal structure adjacent said bottom surface.

4. The assembly of claim 1 wherein said plurality of wall panels have an integrated seal structure along said bottom surface and along said top edge wherein said bottom seal structure is configured to mate with said top edge seal structure.

5. The assembly of claim 1 wherein said plurality of wall panels have an integrated seal structure along each of said two side edges wherein one side edge is configured to mate with the other side edge of an adjacent wall panel.

6. The assembly of claim 1 wherein said floor panels have at least two hollow core regions and at least one U-shaped rib.

7. The assembly of claim 1 wherein said wall panels have a single skin configuration.

8. The assembly of claim 1 wherein said wall panels have a double skin configuration defining one or more cavities.

9. The assembly of claim 8 wherein said wall panels have openable apertures located adjacent said top edge and a bottom edge, said apertures communicating said one or more cavities with the outside air.

10. A method of using a permanent form system comprising:

forming one or more concrete forms using GRC material, said one or more GRC concrete forms designed to create an assembly when assembled, wherein said one or more GRC concrete forms has at least a flange configured to form a least one channel that is a portion of an interconnecting void created when said one or more GRC concrete forms are assembled creating said assembly, said interconnecting void configured for receiving pourable concrete that creates an assembly support structure for said assembly on-site and to permanently join said GRC forms when said one or more GRC forms are assembled as a part of said assembly, said interconnecting void being formed without using a temporary structure to enclose said channel;

constructing steel reinforcement structure configured for placement within said interconnecting void assembling said one or more GRC concrete forms;

disposing said steel reinforcement into said interconnecting void; and disposing concrete within said interconnecting void.

11. A method of constructing a concrete building comprising:

assembling a plurality of pre-cast GRC wall panels to a foundation forming an enclosure, said pre-cast GRC wall panels having a channel along a top edge and side edges configured to form a column void when one of said pre-cast GRC wall panels is assembled adjacent to another one of said pre-cast GRC wall panels and wherein said plurality of pre-cast GRC wall panels forms a continuous channel along said top edge, said column void being in communication with said channel;

inserting steel reinforcement within each column void;

disposing concrete within each column void;

inserting steel reinforcement within said channel;

disposing concrete within said channel; and installing a roof over said enclosure.

12. The method of claim 11 further comprising:

assembling one or more pre-cast GRC floor/roof panels over said enclosure wherein said floor/roof panels are positioned to sit along an inside edge of said top edge channel of said plurality of GRC wall panels and exposing said channel; and disposing concrete over said floor/roof panels and within said channel.

* * * * *